252-95 AU 166 EX
10/6/81 XR 4,293,639

United States Patent [19]

Itoh et al.

[11] 4,293,639

[45] Oct. 6, 1981

[54] BLEACHING COMPOSITIONS FOR PHOTOGRAPHIC PROCESSING

[75] Inventors: Isamu Itoh; Taiji Hashimura; Takatoshi Ishikawa, all of Minami-ashigara, Japan

[73] Assignee: Fuji Photo Film Co., Ltd., Kanagawa, Japan

[21] Appl. No.: 148,356

[22] Filed: May 9, 1980

[30] Foreign Application Priority Data

May 9, 1979 [JP] Japan ..... 54-57434

[51] Int. Cl.[3] ..... G03C 5/32; G03C 7/16

[52] U.S. Cl. ..... 430/393; 430/430; 430/461; 252/95

[58] Field of Search ..... 430/372, 393, 430, 431, 430/460, 461, 462, 427; 252/186, 187 R, 79.1, 79.2, 79.4

[56] References Cited

U.S. PATENT DOCUMENTS

| | | | |
|---|---|---|---|
| 3,761,262 | 9/1973 | Schranz et al. | 430/372 |
| 3,772,020 | 11/1973 | Smith | 430/393 |
| 3,879,202 | 4/1975 | Yamaguchi | 430/372 |
| 3,948,659 | 4/1976 | Yamaguchi et al. | 430/393 |

OTHER PUBLICATIONS

Research Disclosure, Nov. 1978, 17556, p. 42.

*Primary Examiner*—Mary F. Downey
*Attorney, Agent, or Firm*—Sughrue, Mion, Zinn, Macpeak & Seas

[57] ABSTRACT

The generation of toxic gases from a bleaching composition for silver halide color photographic materials containing a bleaching agent such as a persulfate or an inorganic ferric salt and a water-soluble halide can be prevented by the incorporation therein of a compound represented by the formula [I]:

$$R^1—X—NH—R^2 \quad [I]$$

wherein X is a carbonyl group or a sulfonyl group; $R^1$ is an alkyl group, an alkenyl group, a phenyl group, an alkoxy group, an amino group, an acylamino group, or a heterocyclic ring; and $R^2$ is a hydrogen atom, an alkyl group, an alkenyl group, a phenyl group, an acyl group, a carbamoyl group, or a heterocyclic ring; or $R^1$ and $R^2$ together form a 5- or 6-membered ring or a tautomer thereof.

18 Claims, No Drawings

BLEACHING COMPOSITIONS FOR PHOTOGRAPHIC PROCESSING

BACKGROUND OF THE INVENTION

1. Field of the Invention

This invention relates to a bleaching composition for processing silver halide color photographic materials. More particularly, the invention relates to preventing the generation of toxic gases, such as a halogen gas, from the bleaching solution containing a bleaching agent and a halide.

2. Description of the Prior Art

In the photographic processing of silver halide color photographic materials, photosensitive materials (including silver halide photographic emulsions that may have been previously fogged) are, after being imagewise exposed, usually developed by a developer containing an aromatic primary amine color developing agent in the presence of dye-forming couplers, and then the developed silver formed simultaneously is rehalogenated in a bleaching step and removed by fixing or blixing.

It has hitherto been known to use a prussiate (ferricyanate), a dichromate, a ferric salt, an organic acid ferric complex salt, or a persulfate as a bleaching agent, and a water-soluble halide such as sodium chloride, ammonium chloride, sodium bromide, etc., as a rehalogenating agent in bleaching compositions for the bleaching step.

Prussiates (ferricyanates) are good bleaching agent in that they provide sufficiently high bleaching rate (oxidation rate) and oxidize sufficiently developed within a predetermined period of time. However, a bleaching solution using a prussiate (ferricyanate) as a bleaching agent releases cyanide ions due to photolysis, which causes environmental pollution. Hence the waste bleaching solution must be subjected to a treatment in order to make the waste solution completely harmless.

A bleaching solution using a dichromate as a bleaching agent results in formation of dichromate ions, which also causes problems, and hence the waste solution thereof must also be subjected to a treatment for making it completely harmless.

These conventional compositions which require an extra treatment for making the waste solutions thereof completely harmless have the defect of imposing serious burden on their industrial applications.

It has also been known to use solutions-containing persulfates, inorganic ferric salts, organic acid ferric complexes, etc., as a bleaching solutions, in order to overcome the difficulties encountered using prussiates (ferricyanates) or dichromates. Some of these bleaching agents, especially inorganic ferric salts, are insoluble in weakly acidic or alkaline solutions, and the bleaching rate is insufficiently high under such conditions. Hence the bleaching solution is frequently used at a low pH, in order to increase the oxidizing power, and thereby the bleaching rate is increased. Increasing the oxidizing power by reducing the pH of the bleaching solution can also be effective when using dichromates, but is particularly effective for practical use when using persulfates or ferric salts, in that the burden required for the treatment of the waste solution is slight.

However, when the oxidizing power of a bleaching solution using a persulfate or an inorganic ferric salt as the bleaching agent is increased by reducing the pH of the bleaching solution, the bleaching agent reacts with chloride or bromide existing in the bleaching solution as a re-halogenating agent to generate chlorine or bromine, respectively which causes serious problems in the working environment. Furthermore, the formation of chlorine or bromine is accompanied by the corrosion of parts of the processing equipment. Therefore, it is very difficult to use bleaching processes using a persulfate or an inorganic ferric salt as the bleaching agent unless the above-mentioned difficulties are overcome.

Various substances supposedly capable of preventing the formation of chlorine or bromine by the oxidation of a chloride or a bromide with a bleaching agent contained in a bleaching solution have been proposed, such as gelatin, various amino acids, aliphatic monocarboxylic acids, cobalt salts, etc., as described in *Research Disclosure,* 17556 (1978, November). However, many of these compounds have the defect that they do not always show a sufficient effect to prevent the generation of chlorine or bromine. Even if they have an excellent prevention effect, they may give off an irritating smell or cause rust, or suffer the defect that they are lacking in stability in a processing solution and accelerate the decomposition of the persulfate, thereby reducing the effective life of the bleaching solution and the bleaching power thereof. Others suffer the defect that the pH of a bleaching solution containing such compounds deviates due to their presence, and lacks in stability. Thus a need for improved bleaching solution is apparent.

SUMMARY OF THE INVENTION

It is therefore an object of this invention to provide a bleaching composition which does not cause environmental pollution and which shows a high bleaching speed.

Another object of this invention is to provide a bleaching composition wherein the generation of toxic gases such as a halogen gas is prevented.

A third object of this invention is to provide a bleaching solution which prevents the generation of toxic gases such as chlorine gas or bromine gas without causing the corrosion of photographic processing equipment.

A further object of this invention is to provide a bleaching composition which is stable with respect to the decomposition of the bleaching agent in the bleaching solution, which shows little or no deviation of the pH of the bleaching solution, with a stably maintained bleaching power and a reduction in the need to supplement the bleaching agent.

A still further object of this invention is to provide a process for bleaching silver halide color photographic materials using bleaching compositions as described above.

DETAILED DESCRIPTION OF THE INVENTION

The above-described objects of this invention can be attained by the provision of a bleaching composition for silver halide color photographic materials comprising: (1) a persulfate or an inorganic ferric salt, (2) a water-soluble halide, and (3) a compound represented by the formula [I]

$$R^1—X—NH—R^2 \qquad [I]$$

wherein X represents a carbonyl group or a sulfonyl group; $R^1$ represents an alkyl group, an alkenyl group, a phenyl group, an alkoxy group, an amino group, an acylamino group, or a heterocyclic ring; and $R^2$ represents a hydrogen atom, an alkyl group, an alkenyl group, a phenyl group, an acyl group, a carbamoyl group, or a heterocyclic ring; or $R^1$ and $R^2$ together form a 5- or 6-membered ring.

In formula [I], the alkyl groups represented by $R^1$ and $R^2$ are preferably alkyl groups having from about 1 to 4 carbon atoms, such as a methyl group, an ethyl group, an isopropyl group, a t-butyl group, and so forth. The alkyl groups may have a substituent, such as, for example, a hydroxy group, a sulfo group, a lower alkoxy group, such as methoxy group, and so forth. The alkenyl groups represented by $R^1$ or $R^2$ preferably have from about 2 to 4 carbon atoms, such as a vinyl group, an allyl group, a butenyl group, and so forth. The heterocyclic ring that may constitute $R^1$ or $R^2$ preferably are 5- or 6-membered nitrogen-containing heterocyclic ring, such as, for example, an isoxazolyl group, a pyridyl group, a pyrazyl group, a pyrimidyl group, a triazinyl group, etc. The alkoxy groups represented by $R^1$ preferably have from about 1 to 4 carbon atoms, such as, for example, a methoxy group, an ethoxy group, a propoxy group, an isobutoxy group, and so forth. An amino groups represented by $R^1$ is preferably an unsubstituted amino group, or an amino group substituted by an alkyl group having from about 1 to 4 carbon atoms, an alkenyl group having 2 to 4 carbon atoms, or a phenyl group. Examples thereof include an amino group, a methylamino group, a diethyl amino group, an anilino group, a hydroxyethylamino group, and so forth. The acylamino groups represented by $R^1$ preferably have from about 1 to 4 carbon atoms, such as, for example, a formylamino group, an acetylamino group, a butyrylamino group, and so forth. The acyl groups represented by $R^2$ preferably have from about 1 to 4 carbon atoms, such as a formyl group, an acetyl group, a propionyl group, and so forth. The phenyl groups represented by $R^1$ and $R^2$ can be an unsubstituted phenyl group or a phenyl group substituted by an alkyl group having from about 1 to 4 carbon atoms, a hydroxy group, an alkoxy group having from about 1 to 4 carbon atoms (which may have a further substituent), a substituted amino group having from about 1 to 4 carbon atoms or an unsubstituted amino group.

$R^1$ and $R^2$ together may form a 5- or 6-membered ring; preferred examples of such rings include an α-pyridone ring, an α-pyrrolidone ring, a succinimido ring, a phthalimido ring, a saccharin ring, a hydantoin ring, a cyanuric acid ring, and so forth. The ring formed by $R^1$ and $R^2$ may include substituents, such as an alkyl group having from about 1 to 3 carbon atoms, an alkenyl group having from about 2 to 4 carbon atoms, an alkoxy group having from about 1 to 6 carbon atoms, a phenyl group, a hydroxy group, a hydroxymethyl group, and so forth.

Further, the ring formed by $R^1$ and $R^2$ may condense with another ring.

The detailed mechanism by which the generation of chlorine gas or bromine gas from the bleaching solution is prevented by compounds according to the invention has not yet been clarified. However, it has been found that a compound having an >N—H group adjacent to a carbonyl group or a sulfonyl group as is shown in formula [I] is effective for preventing the generation of halogen gases. The compound of formula [I] used according to the invention may be present as a tautomer in the bleaching solution, i.e., being present in a form in which the hydrogen atom of the >N—H group is dissociated therefrom and bonded to the oxygen atom of the carbonyl group or the sulfonyl group. It is understood that formula [I] is intended to represent the compound in either tautomeric form.

Especially preferred compounds according to formula [I] are shown by formulae [I-a] or [I-b]

$$R^1—CO—NH—CO—R^2 \quad \text{[I-a]}$$

$$R^1—SO_2—NH—CO—R^2 \quad \text{[I-b]}$$

wherein $R^1$ and $R^2$ have the same meanings as in formula [I].

Examples of these compounds include carboimido compounds, hydantoin and derivatives thereof, uracil and derivatives thereof, cyanuric acid, pyrimidin-2,4-dione, and so forth.

Examples of preferred compounds of formula [I] are illustrated below:

(1) $CH_3C(=O)NH_2$ (2) $C_2H_5C(=O)NHC_2H_5$ (3) $CH_3S(=O)_2NHCH_2CH=CH_2$ (4) $CH_3S(=O)_2NH-C_6H_4-OCH_3$ (5) $CH_2=CHCH_2S(=O)_2NH_2$ (6) $CH_2=CHCH_2C(=O)NH-C_6H_5$ (7) 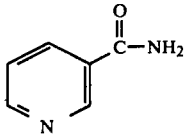

(8) $HOCH_2CH_2C(=O)NH-C_5H_4N$ (9) $C_6H_5-S(=O)_2-NH_2$

(10) $C_6H_5-S(=O)_2NHCH_2CH_2OH$

(11) $C_6H_5-C(=O)NHCH_2CH_2CH_3$

(12) $H_2N-C_6H_4-S(=O)_2NH-C_6H_4-OH$

(13) $CH_3S(=O)_2NHC(=O)CH_3$

(14) $C_6H_5-C(=O)NHC(=O)CH_3$

(15) $(CH_3)_2N-C_6H_4-S(=O)_2NHC(=O)CH_3$

(16) $CH_3C(=O)NHC(=O)NH_2$

-continued (17)

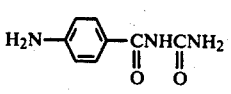

(18) $CH_3OCNH_2$ ‖ O

(19) $CH_3OCNHCH_2CH_2OCH_3$ ‖ O

(20) $CH_3OCH_2CH_2OCNHCCH_3$ ‖ O ‖ O (21)

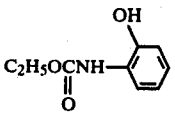

(22) $NH_2CNH_2$ ‖ O

(23) $CH_2{=}CHCH_2NHCNHC_2H_5$ ‖ O

(24) $C_2H_5NHCNHCCH_3$ ‖ O ‖ O (25)

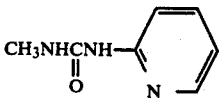

(26) $CH_3NHCNHCH_2CH_2OH$ ‖ O (27)

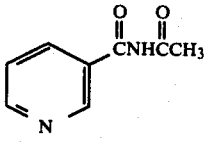

(28)

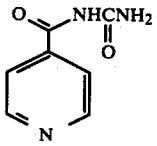

(29)

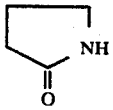

(30)

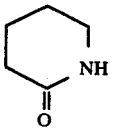

(31)

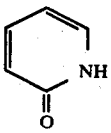

(32)

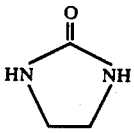

(33)

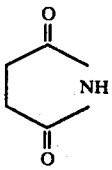

(34)

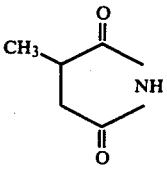

(35)

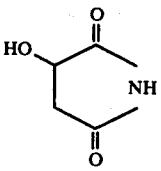

(36)

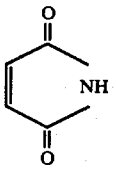

(37)

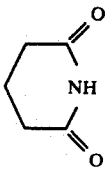

(38)

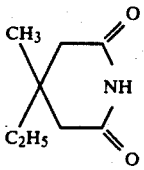

-continued (39)

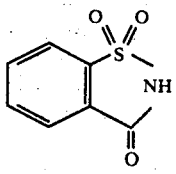

(40)

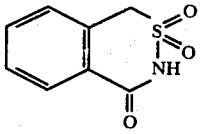

(41)

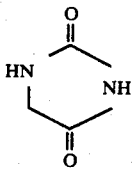

(42)

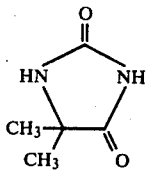

(43)

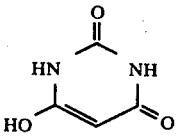

(44)

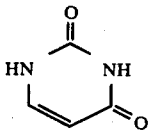

(45)

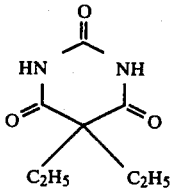

(46)

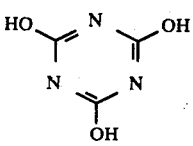

Preferred persulfates used as the bleaching agent (compound (1)) for the bleaching compositions of the invention are alkali metal persulfates such as potassium persulfate, sodium persulfate, etc., and ammonium persulfate. Also, preferred inorganic ferric salts are ferric chloride, ferric bromide, ferric sulfate, ferric nitrate, and so forth. The preferred amount of the above-mentioned bleaching agent is about 0.1 to 2 moles per liter of bleaching solution.

The halide (compound (2)) used for the bleaching compositions of the invention include chlorides such as potassium chloride, sodium chloride, ammonium chloride, etc., and bromides such as potassium bromide, sodium bromide, ammonium bromide, etc. The preferred amount of the halide is about 0.1 to 2 moles per liter of bleaching solution.

The bleaching solution of this invention may further contain one or more inorganic acids, organic acids and the salts thereof having a pH buffering action, such as boric acid, borax, sodium metaborate, acetic acid, sodium acetate, sodium carbonate, potassium carbonate, phosphorous acid, phosphoric acid, sodium phosphate, citric acid, sodium aitrate, tartaric acid, and so forth.

In addition, a salt such as sodium sulfate, potassium sulfate may be added to the bleaching solution of the present invention in order to control the salt concentration of the bleaching solution.

The amount of the compound of formula [I] used according to the invention is from about $2\times10^{-6}$ to $1\times10^{-1}$ mole, and preferably from $1\times10^{-2}$ to $4\times10^{-2}$ mole per liter of bleaching solution. The pH of the bleaching solution according to the invention is desirably from about 1.0 to 7.0, and preferably from 2.0 to 6.0 at the time of use.

The bleaching solution of this invention can also contain various bleach accelerators. Preferred bleach accelerators include, for example, the mercapto compounds and dithiocarbamate compounds described in: U.S. Pat. Nos. 3,707,374, 3,772,020, and 3,893,858; Japanese Patent Publication No. 28227/76; Japanese Patent Application (OPI) Nos. 94927/78 and 95631/78; Japanese Patent Application Nos. 97980/78 and 98901/78; and *Research Disclosure,* 15704 (May, 1977).

Preferred bleach accelerator compounds can be represented by the following formula [II]

$$X—A—SH \qquad [II]$$

wherein A represents an alkylene group or a nitrogen-containing unsaturated divalent heterocyclic ring and X represents an alkyl-substituted or unsubstituted amino group, a nitrogen-containing saturated heterocyclic ring, a hydroxy group, a carboxy group or a sulfo group. Also, precursors of compounds of formula [II] can be used.

Particularly preferred bleach accelerator compounds represented by formula [II] can be represented by the following formula [III]

$$X—(CH_2)_n—SH \qquad [III]$$

wherein X represents an N,N-dimethylamino group, an N,N-diethylamino group, a carboxy group, or a sulfo group, and n is an integer of 2 or 3. Also, precursors of compounds of formula [III] can be used.

Specific examples of preferred bleach accelerator compounds according to formula [II] are as follows:

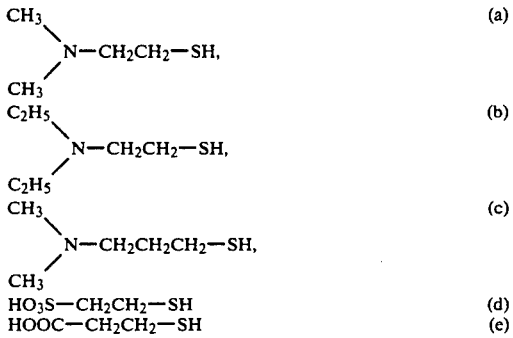

Specific example of a preferred precursor of bleaching accelerator compounds according to formula [II] is as follows:

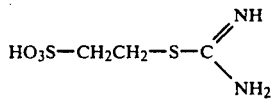

The above-mentioned precursor generally releases

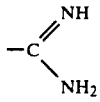

group in alkaline solution to become the bleaching accelerator compound represented with the formula (d). The use of precursors of the bleaching accelerator compounds is advantageous from the standpoint that the generation of irritative smells can be restrained at a minimum.

The above-mentioned bleach accelerator may be added to a processing bath other than the bleaching solution employed after color development and prior to bleaching, such as a color development bath, a simple water bath, a stop bath, and stop-fix bath.

To prepare a bleaching solution using the bleaching composition of the invention, after preparing an aqueous solution of component (1) and component (2) and, if desired, other additives, component (3), which is a compound according to formula [I] is added to the aqueous solution in the solid state or as an aqueous solution. Alternatively, after preparing an aqueous solution of component (2) and component (3) and, if desired, other additives, the bleaching agent (compound (1)) is added to the aqueous solution. If a compound according to formula [I] of this invention is not present in the preparation of the bleaching solution, chlorine gas and/or bromine gas is gradually generated, which makes it difficult to continue the operation of preparing the bleaching solution. On the other hand, when a compound according to formula [I] is added to the solution, the generation of such gases is completely restrained, and the generation of other irritative smells is also completely prevented, which makes unnecessary the troublesome use of protectors and gas exhaust devices.

The bleaching compositions of this invention can be used for the processing of any color photographic materials using silver halide, such as color photographic papers, color photographic negative films, color photographic reversal films, color photographic positive films, etc., but the bleaching compositions of this invention are advantageously used for the processing of color photographic materials of high-silver content, (i.e., silver halide emulsions in which the total amount of silver in the silver halide emulsion layers is more than 30 mg per 100 $cm^2$, and particularly where the total amount of silver is over 40 mg per 100 $cm^2$.

The following treatment processes illustrate the fundamental steps for processing image-exposed color photographic negative films, color photographic positive films, or color photographic papers in which the bleaching compositions of this invention can be used:

(i) Color development→stop→bleach→wash→fix→wash→stabilization→dry, (ii) color development→stop→bleach→fix→wash→stabilization→dry, or (iii) color development→stop-fix→bleach→fix→wash→stabilization→dry.

In treatments (i) to (iii), a pre-bath, a hardening bath, etc., may be employed before the color development, and wash, after-stabilization and/or bleach steps may be omitted.

On the other hand, the following treatment schemes are usually employed as the fundamental steps for processing color photographic reversal films:

(iv) Black and white development→stop→wash→fogging→wash→color development→stop→wash→bleach→wash→fix→wash→stabilization→dry; or (v) black and white development→stop→wash→fogging→wash→color development→stop→wash→bleach→fix→wash→stabilization→dry.

In the treatments (iv) or (v), a pre-bath, a prehardening bath, a neutralization bath, etc., may also be employed. Also, various wash, after-stabilization, bleach, etc., steps may be omitted. The fogging bath may be replaced with a re-exposure step, and the fogging bath may be omitted by incorporating a fogging agent in the color developer used in the treatment.

Although the photographic process of this invention the treatments (i) to (v) described above, the invention is not limited to these treatments only.

The following examples are intended to illustrate this invention in detail but not to limit it in any way.

EXAMPLE 1

In a one liter narrow-mounted polyethylene bottle equipped with a rubber stopper was placed 650 ml of one of the bleaching solutions (A) to (H) prepared by the formulations described below and then the bottle was sealed up by means of the rubber stopper with an iron piece suspending over the surface of the bleaching solution in the bottle by means of a piece of string. Thereafter, the system was aged for 7 days at 40° C. During the aging, a part of the gas in the bottle was sampled every day to quantify the chloride gas generated and check the generation of other irritative smells in addition to the chlorine gas. Also, the formation of rust was determined by observing the iron piece suspended in the bottle. The determination of chlorine gas was performed using a conventional chlorine gas detection tube (Kitagawa, No. 109A) and the existence of other irritative smells other than that of the chlorine gas was determined by the sense of smell.

Bleaching solution (A) contained no compound for preventing the generation of chlorine gas, bleaching solutions (B), (C) and (D) were comparison bleaching solutions containing compounds for preventing the generation of halogen gas other than the compounds according to formula [I] of this invention, and bleaching solutions (E), (F), (G) and (H) were the bleaching solutions containing compounds according to formula [I] of this invention.

The compositions of the bleaching solutions used in this experiment were shown below:

| | | |
|---|---|---|
| Bleaching solution (A): | | |
| Water | 800 | ml |
| Sodium Persulfate | 60 | g |
| Sodium Chloride | 30 | g |
| Phosphoric Acid (85%) | 11.8 | ml |
| Sodium Hydroxide | 6.4 | g |
| Water to make | 1 | liter |
| pH | 2.7 | |
| Bleaching solution (B): | | |
| Water | 800 | ml |
| Sodium Persulfate | 60 | g |
| Sodium Chloride | 30 | g |
| Phosphoric Acid (85%) | 11.8 | ml |
| Sodium Hydroxide | 6.4 | g |
| Triethanolamine | 3.3 | g |
| Water to make | 1 | liter |
| pH | 3.6 | |
| Bleaching solution (C): | | |
| Water | 800 | ml |
| Sodium Persulfate | 60 | g |
| Sodium Chloride | 30 | g |
| Phosphoric Acid (85%) | 11.8 | ml |
| Sodium Hydroxide | 6.4 | g |
| Glycine | 1.7 | g |
| Water to make | 1 | liter |
| pH | 3.3 | |
| Bleaching solution (D): | | |
| Water | 800 | ml |
| Sodium Persulfate | 60 | g |
| Sodium Chloride | 30 | g |
| Phosphoric Acid (85%) | 11.8 | ml |

-continued

| | | |
|---|---|---|
| Sodium Hydroxide | 6.4 | g |
| β-Alanine | 2.0 | g |
| Water to make | 1 | liter |
| pH | 3.4 | |
| Bleaching solution (E): | | |
| Water | 800 | ml |
| Sodium Persulfate | 60 | g |
| Sodium Chloride | 30 | g |
| Phosphoric Acid (85%) | 11.8 | ml |
| Sodium Hydroxide | 6.4 | g |
| Compound (7) | 2.7 | g |
| Water to make | 1 | liter |
| pH | 2.7 | |
| Bleaching solution (F): | | |
| Water | 800 | ml |
| Sodium Persulfate | 60 | g |
| Sodium Chloride | 30 | g |
| Phosphoric Acid (85%) | 11.8 | ml |
| Sodium Hydroxide | 6.4 | g |
| Compound (33) | 2.2 | g |
| Water to make | 1 | liter |
| pH | 2.7 | |
| Bleaching solution (G): | | |
| Water | 800 | ml |
| Sodium Persulfate | 60 | g |
| Sodium Chloride | 30 | g |
| Phosphoric Acid (85%) | 11.8 | ml |
| Sodium Hydroxide | 6.4 | g |
| Compound (39) | 3.5 | g |
| Water to make | 1 | liter |
| Bleaching solution (H): | | |
| Water | 800 | ml |
| Sodium Persulfate | 60 | g |
| Sodium Chloride | 30 | g |
| Phosphoric Acid (85%) | 11.8 | ml |
| Sodium Hydroxide | 6.4 | g |
| Compound (46) | 2.4 | g |
| Water to make | 1 | liter |
| pH | 2.7 | |

The results obtained are shown in the following table.

TABLE 1

| Bleaching solution | Chlorine gas | Rust | Generation of irritative smell other than Cl gas |
|---|---|---|---|
| (A) | >100 ppm (after 1 day) | observed (after 1 day) | none |
| (B) | 60 ppm (after 7 days) | none | perceived (after 3 days) |
| (C) | 1.3 ppm (after 7 days) | observed (after 7 days) | perceived (after 1 day) |
| (D) | <0.1 ppm (after 7 days | observed (after 7 days) | perceived (after 4 days) |
| (E) | <0.1 ppm (after 7 days) | none | none |
| (F) | <0.1 ppm (after 7 days) | " | " |
| (G) | <0.1 ppm (after 7 days) | " | " |
| (H) | <0.1 ppm (after 7 days) | " | " |

As is clear from the results shown in Table 1, bleaching solution (A) containing no compound for preventing the generation of chlorine gas began to generate chlorine gas immediately after the preparation of the bleaching solution and when the solution was preserved for 1 day at 40° C., the concentration of the chlorine gas reached over 100 p.p.m. Also, in this case the iron piece in the polyethylene bottle began to get rusty after 1 day. Bleaching solution (B) containing the aliphatic amine showed weak effect of preventing the generation of chlorine gas and the chlorine concentration reached 60 p.p.m. after 7 days. Also, after 3 days, the solution began to give irritative smells other than that of chlorine gas. Bleaching solutions (C) and (D) contained known compounds for preventing the generation of chlorine gas as described in *Research Disclosure;* 17556 (November, 1978) began to give irritative smells after 1 day, the chlorine concentration reached 1.3 p.p.m. after 7 days, and the iron piece began to get rusty. On the other hand, in bleaching solution (D) the chlorine concentration could be restrained below 0.1 p.p.m. even after 7 days but irritative smells began to generate after 4 days and the iron piece began to get rusty after 7 days. The components of the irritative smells in bleaching solutions (B), (C) and (D) have not yet been clarified, but they are believed to be based on the oxidation decomposition products of the aliphatic amino group or carboxy group of the compound added and/or the generation of hydrogen chloride.

On the other hand, in bleaching solutions (E) through (H), containing the compounds according to this invention, the chlorine concentration was restrained below 0.1 p.p.m. after 7 days, no formation of rust was observed, and the generation of the irritative smells which were perceived strikingly in above-described bleaching solutions (B), (C) and (D) did not occur. As described above, the bleaching solutions containing the compounds according to this invention possessed very excellent properties in the prevention of the generation of irritative smells other than that of chlorine gas and rust.

An example of performing a complete photographic processing treatment using the bleaching solution containing a compound according to this invention is shown below.

EXAMPLE 2

A polyethylene terephthalate support having a subbing layer thereon was successively coated with the following layers:

A 1st layer (red-sensitive silver halide emulsion layer):

A silver halide emulsion prepared by adding 500 g of a gelatin solution having dispersed therein a cyan coupler (C-1) (7:1 in mole ratio of silver and the coupler), 50 ml of an aqueous solution of 1% stabilizer (A-1), 50 ml of an aqueous solution of 1% coating aid (T-1), and 20 ml of an aqueous solution of 2% hardening agent (H-1) to 1000 g of a silver iodobromide emulsion (silver iodide 5 mole %) containing 10 g of silver halides and 5 g of gelatin per 100 g of the emulsion was coated at a dry thickness of 4 microns.

A 2nd layer (interlayer):

A mixture of 1000 g of a 5% gelatin solution, 100 g of an aqueous solution of gelatin having dispersed therein a color mixing preventing agent (A-2), 50 ml of an aqueous solution of 1% coating aid (T-1), and 20 ml of an aqueous solution of 2% hardening agent (H-1) was coated at a dry thickness of 1 micron.

A 3rd layer (green-sensitive silver halide emulsion layer):

A silver halide emulsion prepared by adding 700 g of an aqueous gelatin solution having emulsified-dispersed therein a magenta coupler (C-2) (7:1 in mole ratio of silver to coupler), 50 ml of an aqueous solution of 1% stabilizer (A-1), 50 ml of an aqueous solution of 1% coating aid (T-1), and 20 ml of an aqueous solution of 2% hardening agent (H-1) to 1,000 g of a silver iodobromide emulsion (5 mole % silver iodide) containing 10 g of silver halide and 5 g of gelatin per 100 g of the silver halide emulsion was coated at a dry thickness of 4 microns.

A 4th layer (yellow filter layer):

A coating composition prepared by adding 100 ml of an aqueous solution of 1% coating aid (T-1) and 20 ml of 2% hardening agent (H-1) to 1,000 g of an aqueous 5% gelatin solution having dispersed therein colloidal silver was coated at a silver coverage of 0.5 mg/100 $cm^2$.

A 5th layer (blue sensitive silver halide emulsion layer):

A silver halide emulsion prepared by adding 500 g of an aqueous gelatin solution having dispersed therein a yellow coupler (C-3) (7:1 in mole ratio of silver to the coupler), 50 ml of an aqueous solution of 1% stabilizer (A-1), 50 ml of an aqueous solution of 1% coating aid (T-1), and 20 ml of an aqueous solution of 2% hardening agent (H-1) to 1,000 g of a silver iodobromide emulsion (5 mole % silver iodide) containing 10 g of silver halide and 5 g of gelatin per 100 g of the silver halide emulsion was coated at a dry thickness of 4 microns.

A 6th layer (protective layer):

An aqueous gelatin solution prepared by adding 100 ml of an aqueous solution of 1% coating aid (T-1) and 20 ml of an aqueous solution of 1% hardening agent (H-1) to an aqueous 5% gelatin solution was coated at a dry thickness of 1 micron.

C-1:

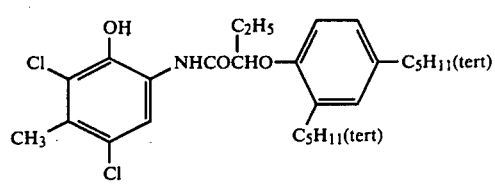

Emulsification method: In a mixture of 100 ml of dibutyl phthalate and 200 ml of ethyl acetate was dissolved 75 g of the cyan coupler (C-1) and the solution was emulsified in 600 g of an aqueous 10% gelatin solution with a dispersing aid.

C-2:

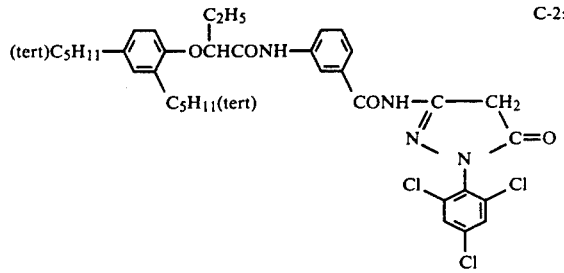

Emulsification method: The same procedure as in the case of the cyan coupler (C-1) was followed except that 75 g of the above-described magenta coupler (C-2) was dissolved in place of the cyan coupler (C-1).

C-3:

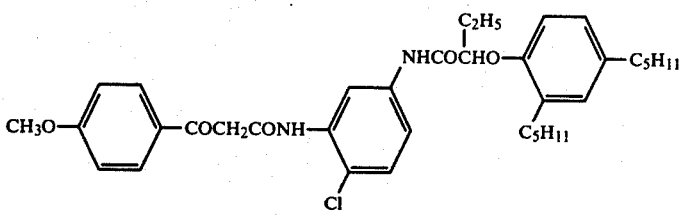

Emulsification method: The same procedure as in the case of the cyan coupler (C-1) was followed except that 90 g of the yellow coupler (C-3) was dissolved in place of the cyan coupler (C-1).

A-1:

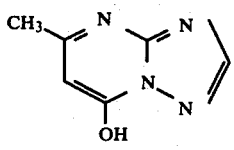

A-2:

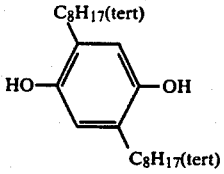

Emulsification method: In a mixture of 200 ml of dibutyl phthalate and 200 ml of ethyl acetate was dissolved 100 g of the color mixing preventing agent (A-2) and the solution was emulsified in 500 g of an aqueous solution of 10% gelatin with a dispersing agent.

T-1:

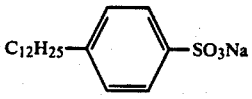

H-1:

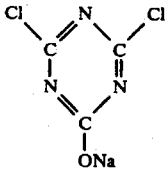

The color photographic reversal film thus prepared was given a proper imagewise exposure, and was then processed by the following processing steps, wherein the bleach solution contained various compounds according to this invention as indicated below.

| | | |
|---|---|---|
| 1st Development | 43° C. | 2 min. |
| 1st Stop | 40° C. | 20 sec. |
| Wash | " | 40 sec. |
| 2nd Development | 46° c. | 2 min. 15 sec. |
| Pre-bath | 40° c. | 15 sec. |
| Wash | " | 5 sec. |
| Bleach | " | 45 sec. |
| Fix | " | 40 sec. |
| Wash | " | 25 sec. |
| Stabilization | " | 20 sec. |

The compositions of the processing solutions used in the above steps were as follows:

| | | |
|---|---|---|
| **1st Developer:** | | |
| Water | | 800 ml |
| Quodrafos (trademark for a produce manufactured by Merck & Co.) | | 2.0 g |
| Anhydrous Sodium Hydrogensulfite | | 8.00 g |
| Phenidone | | 0.35 g |
| Anhydrous Sodium Sulfite | | 37.0 g |
| Hydroquinone | | 5.50 g |
| Anhydrous Sodium Carbonate | | 28.2 g |
| Sodium Rhodanate | | 1.38 g |
| Sodium Bromide | | 1.30 g |
| Potassium Iodide (0.1% solution) | | 13.0 ml |
| Water to make | | 1.00 liter |
| | pH | 9.90 |
| **1st Stop solution:** | | |
| Water | | 800 ml |
| Glacial Acetic Acid | | 30.0 ml |
| Sodium Hydroxide | | 1.65 g |
| Water to make | | 1.00 liter |
| | pH | 3.50 |
| **2nd Developer:** | | |
| Water | | 800 ml |
| Sodium Hexametaphosphate | | 5.0 g |
| Benzyl Alcohol | | 4.50 ml |
| Anhydrous Sodium Sulfite | | 7.50 g |
| Sodium Tertiary Phosphate (12 $H_2O$) | | 36.0 g |
| Sodium Bromide | | 0.90 g |
| Potassium Iodide (0.1% solution) | | 90 ml |
| Sodium Hydroxide | | 3.25 g |
| Citrazinic acid | | 1.50 g/liter |
| N-Ethyl-N-β-methanesulfonamidoethyl-3-methyl-4-aminoaniline sesquisulfate monohydrate | | 11.0 g |
| Ethylenediamine | | 3.00 g |
| tert-Butylamine Borane | | 0.07 g |
| Water to make | | 1.00 liter |
| | pH | 11.65 |
| **Pre-bath:** | | |
| Water | | 800 ml |
| Glacial Acetic Acid | | 10 ml |
| Anhydrous Sodium Sulfite | | 12 g |
| 2-N,N-Dimethylaminoethylthiuronium Chloride Hydrochloride | | 4.4 g |
| Water to make | | 1 liter |
| | pH | 3.5 |
| **Bleach solution:** | | |
| Water | | 800 ml |
| Sodium Persulfate | | 60 g |
| Sodium Chloride | | 30 g |
| Phosphoric Acid (85%) | | 11.8 ml |
| Sodium Hydroxide | | 6.4 g |
| Compound according to this invention, or a known compound, as indicated in Table 2 | | |
| Water to make | | 1 liter |
| **Fix solution:** | | |
| Water | | 600 ml |
| Ammonium Thiosulfate (58%) | | 169 ml |
| Anhydrous Sodium Sulfite | | 11.5 g |
| Disodium Ethylenediaminetetraacetate | | 0.5 g |
| Anhydrous Sodium Acetate | | 12 g |
| Glacial Acetic Acid | | 9 ml |
| Water to make | | 1 liter |
| | pH | 5.5 |
| **Stabilization bath:** | | |
| Water | | 800 ml |
| Formalin (37.5%) | | 6 ml |

-continued

| | |
|---|---|
| Water to make | 1 liter |

After finishing the processing treatment as outlines above, the amount of silver remaining in each film sample was determined by X-ray fluorescent analysis. Also, after continuing use of the processing treatment for two weeks, the bleaching solution was checked to determine the pH change and the potential change with pH meter using a glass electrode and a saturated calomel electrode in the former case and using a platinum electrode and a saturated colomel electrode in the latter case. The results obtained are shown in Table 2.

TABLE 2

| Bleaching solution | Compound added | Amount | Amount of Ag | pH change | Potential change |
|---|---|---|---|---|---|
| | | (g/l) | ($\mu g/cm^2$) | | |
| (A) | none | — | 2.4 | 2.7→1.9 | 1000→1150 |
| (D) | β-alanine | 2.0 | 2.4 | 3.4→1.9 | 800→840 |
| (F) | (33)** | 2.2 | 2.2 | 2.7→1.9 | 850→870 |
| (I) | (44) | 2.3 | 2.5 | 2.7→1.9 | 820→850 |
| (H) | (46)** | 2.4 | 2.4 | 2.7→1.9 | 800→840 |

*Known compound.
**Compound according to this invention.

As is shown in Table 2, in the films processed by the bleaching solutions containing compounds according to this invention the removal of silver was accelerated as in the case of films processed by the bleaching solution containing a known compound or, not containing such a compound shown in the table, the clear color images were provided. It was also confirmed that quality of the color images obtained was substantially equal to the quality of color images obtained by standard processing (for example, using hexacyanoferrate as the bleaching agent) in color density, linearity-retaining property, heat and light stability, and so forth.

The silver removing power was kept at almost same level even after two weeks and there no difference was observed in the silver removing power among the film samples processed by the bleaching solutions (A), (D), (F), (I) and (H). The bleaching solutions (F), (I) and (H) showed less change in pH after two weeks than in the case of the bleaching solution (A) containing no such a compound and as compared with the bleaching solution (D) containing the known compound. This shows that the bleaching power of the bleaching solutions (F), (I) and (H) was more stable than that of the bleaching solution (D). The bleaching solution (A) showed the largest potential change, which shows the adverse effect of the generation of chlorine gas. On the other hand, the potential change in the bleaching solution (F), (I) and (H) containing the compounds of this invention was same as or less than that of the bleaching solution (D) containing the comparison compound, which shows the compounds of this invention being excellent in the prevention of the generation of chlorine gas.

Thus, it will be understood that the practice of rapid development processing becomes possible by using the compounds according to this invention with less environmental problems.

EXAMPLE 3

A color photographic negative film sample was prepared by coating a cellulose triacetate film having a subbing layer thereon successively with the following layers.

A 1st layer (antihalation layer):

A gelatin layer containing black colloid silver.

A 2nd layer (interlayer):

A gelatin layer containing an emulsion of 2,5-di-t-octylhydroquinone.

A 3rd layer (low-speed red-sensitive silver halide emulsion layer):

A layer of a low-speed red-sensitive silver iodobromide emulsion (silver iodide 6 mole %, mean grain size 0.8 micron, and gelatin 70 g/kg-emulsion) containing the following additives at each coverage shown below:

Coverage of silver 2.2 $g/m^2$

Sensitizing dye I $3.0\times10^{-4}$ mole per mole of silver.
Sensitizing dye II $0.8\times10^{-4}$ mole per mole of silver.
Coupler A at a coverage of $160\times10^{-5}$ mole/$m^2$,
Coupler B at a coverage of $19\times10^{-5}$ mole/$m^2$.
DIR coupler F at a coverage of $2\times10^{-5}$ mole/$m^2$.

A 4th layer (high-speed red-sensitive silver halide emulsion layer):

A layer of a high-speed silver iodobromide emulsion (silver iodide 5 mole %, mean grain size 1.2 microns, and gelatin 70 g/kg-emulsion) containing the following additive at each coverage shown below:

Coverage of silver 2.4 $g/m^2$

Sensitizing dye I $1.5\times10^{-4}$ mole per mole of silver.
Sensitizing dye II $0.4\times10^{-4}$ mole per mole of silver.
Coupler A at a coverage of $27\times10^{-5}$ mole.

A 5th layer (interlayer):

Same as the 2nd layer.

A 6th layer (low-speed green-sensitive silver halide emulsion layer):

A layer of a low-speed silver iodobromide emulsion (silver iodide 7 mole %, mean grain size 0.8 micron, and gelatin 70 g/kg-emulsion) containing the following additives at each coverage shown below:

Coverage of silver 1.9 $g/m^2$

Sensitizing dye III $4.0\times10^{-4}$ mole per mole of silver.
Sensitizing dye IV $0.5\times10^{-4}$ mole per mole of silver.
Coupler C at a coverage of $74\times10^{-5}$ mole/$m^2$.
Colored coupler D at a coverage of $12\times10^{-5}$ mole/$m^2$.
DIR Coupler F at a coverage of $3.6\times10^{-5}$ mole/$m^2$.

A 7th layer (high-speed green-sensitive silver halide emulsion layer):

A layer of a high-speed silver iodobromide emulsion (silver iodide 8 mole %, mean grain size 1.2 microns, and gelatin 70 g/kg-emulsion):

Coverage of silver 1.8 $g/m^2$

Sensitizing dye III $2.0\times10^{-4}$ mole per mole of silver.
Sensitizing dye IV $0.3\times10^{-4}$ mole per mole of silver.
Coupler C at a coverage of $22\times10^{-5}$ mole/$m^2$.
Colored coupler D at a coverage of $4\times10^{-5}$ mole/$m^2$.

A 8th layer (yellow filter layer):

A gelatin layer containing a emulsified dispersion of yellow colloid silver and 2,5-di-t-octylhydroquinone.

A 9th layer (low-speed blue-sensitive silver halide emulsion layer):

A layer of a low-speed silver iodobromide emulsion (silver iodide 7 mole %, mean grain size 0.8 microns, and gelatin 70 g/kg-emulsion) containing the following additives at each coverage.

| | |
|---|---|
| Coverage of silver | 0.8 g/m² |

Coupler E at a coverage of $150\times10^{-5}$ mole/m².
DIR coupler F at a coverage of $2\times10^{-5}$ mole/m².

A 10th layer (high-speed blue-sensitive silver halide emulsion layer):

A layer of a high-speed blue-sensitive silver iodide emulsion (silver halide 8 mole %, mean grain size 1.3 microns, and gelatin 70 g/kg-emulsion) containing the following coupler at the coverage shown below.

| | |
|---|---|
| Coverage of silver | 0.9 g/m² |

Coupler E at a coverage of $22\times10^{-5}$ mole/m².

A 11th layer (protective layer):

A gelatin layer.

Each layer described above contained a gelatin hardening agent, a coating aid, etc., in addition to each composition described above.

The material used in these layers were as follows:

Sensitizing dye I: Anhydro-5,5'-dichloro-3,3'-disulfopropyl-9-ethyl-thiacarbocyanine hydroxide pyridinium salt.

Sensitizing dye II: Anhydro-9-ethyl-3,3'-di-(3-sulfopropyl)-4,5,4',5'-dibenzothiacarbocyanine hydroxide triethylamide salt.

Sensitizing dye III: Anhydro-9'-ethyl-5,5'-dichloro-3,3'-disulfopropyloxacarbocyanine sodium salt.

Sensitizing dye IV: Anhydro-5,6,5',6'-tetrachloro-1,1'-diethyl-3,3'-di(sulfopropoxyethoxyethyl-)imidazolocarbocyanine hydroxide sodium salt.

Coupler A: 1-Hydroxy-N-[γ-(2,4-di-t-amylphenoxy-propyl)]-2-naphthamide.

Coupler B: 1-Hydroxy-4-[2-(2-hexyldecyloxycarbonyl)-phenylazo]-2-[N-(1-naphthal)]naphthamide.

Coupler C: 1-(2,4,6-Trichlorophenyl)-3-{3-[α-(2,4-di-t-amylphenoxy)acetamido]benzamido}-5-pyrazolone.

Coupler D: 1-(2,4,6-Trichlorophenyl)-3-{3-[α-(2,4-di-t-amylphenoxy)acetamido]benzamido}-4-methoxy-phenylazo-5-pyrazolone.

Coupler E: α-(2,4-Dioxo-5,5'-dimethyloxazolidinyl)-α-pyvaloyl-2-chloro-5-[α-(2,4-di-t-amylphenoxy)-butylamido]acetanilide.

Coupler F: A mixture of α-[5-(3-Methyl-2-benzothiazolylidenamino)-1-benzotriazolyl]-α-(4-octadecyloxybenzyl)-2-ethoxyacetanilide and α-[6-(3-Methyl-2-benzothiazolylidenamino)-1-benzotriazolyl]-α-(4-octadecyloxybenzyl)-2-ethoxyacetanilide.

The above described coupler emulsions were prepared by dissolving each coupler in a mixture of dibutyl phthalate and tricresyl phosphate and dispersing the solution in an aqueous gelatin solution in an oil in water type using sorbitan monolaurate, Turkey red oil, and sodium dodecylbenzenesulfonate as a dispersion-emulsifying agent.

The photographic element thus prepared were exposed (1/50 sec., 10 C.M.S.) by means of an actinometer and then processed at 38° C. according to the following processing steps:

| | | |
|---|---|---|
| 1. Color development | 3 min. | 15 sec. |
| 2. Pre-bath | | 30 sec. |
| 3. Bleach | 2 min. | |
| 4. Fix | 3 min. | 15 sec. |
| 5. Wash | 2 min. | 10 sec. |

-continued

| | |
|---|---|
| 6. Stabilization | 30 sec. |

The compositions of the processing solutions used in the above processing treatment steps were as follows:

| | | |
|---|---|---|
| Color developer: | | |
| Sodium Nitrilotriacetate | 1.9 | g |
| Sodium Sulfite | 4.0 | g |
| Sodium Carbonate | 30.0 | g |
| Potassium Bromide | 1.4 | g |
| Potassium Iodide | 1.3 | g |
| Hydroxylamine Sulfate | 2.4 | g |
| 4-(N-Ethyl-N-β-hydroxyethylamino)-2-methylaniline sulfate | 4.5 | g |
| Water to make | 1 | liter |
| pH | 10.0 | |
| Pre-bath: | | |
| Glacial Acetic Acid | 10 | ml |
| Sodium Sulfite | 12 | g |
| 2-N,N-Dimethylaminoethylthiuronium chloride hydrochloride | 4.4 | g |
| Water to make | 1 | liter |
| Bleach solution: | | |
| Water | 800 | ml |
| Sodium Persulfate | 70 | g |
| Sodium Chloride | 25 | g |
| Phosphoric Acid (85%) | 11.8 | ml |
| Sodium Hydroxide | 6.4 | g |
| Compound according to this invention or a known compound, as indicated in Table 3 | | |
| Water to make | 1 | liter |
| Fix solution: | | |
| Sodium Tetrapolyphosphate | 2.0 | g |
| Sodium Sulfite | 4.0 | g |
| Ammonium Thiosulfate (70%) | 175.0 | ml |
| Sodium Hydrogensulfite | 4.6 | g |
| Water to make | 1 | liter |
| pH | 6.6 | |
| Stabilization solution: | | |
| Formalin (40%) | 8.0 | ml |
| Water to make | 1 | liter |

The results obtained are shown in the following table.

TABLE 3

| Bleaching solution | Compound added to the solution | Amount | Amount of Ag in processed film |
|---|---|---|---|
| | | (g/liter) | (μg/cm²) |
| (A) | none | — | 2.5 |
| (D) | β-alanine | 2.0 | 2.5 |
| (J) | (29) | 1.6 | 2.5 |
| (F) | (33) | 2.2 | 2.2 |
| (K) | (41) | 2.5 | 2.6 |

As is shown in Table 3, the films processed using the bleaching solutions (J), (F) and (K) containing the compounds according to this invention accelerated silver removal and gave clear color images as the film processed using the bleaching solution containing the known compound or containing no such a compound. It was also confirmed that the quality of the color images obtained was substantially equal to the color images obtained by standard processing using hexacyanoferrate as the bleaching agent.

While the invention has been described in detail and with reference to specific embodiments thereof, it will be apparent to one skilled in the art that various changes and modifications can be made therein without departing from the spirit and scope thereof.

What is claimed is:

1. A bleaching composition for silver halide photographic materials comprising (1) a persulfate or an inorganic ferric salt, (2) a water-soluble halide, and (3) a compound represented by the formula [I-a] or [I-b]

$$R^1—CO—NH—CO—R^2 \quad [I\text{-}a]$$

$$R^1—SO_2—NH—CO—R^2 \quad [I\text{-}b]$$

$R^1$ represents an alkyl group having 1 to 4 carbon atoms, an alkenyl group having 2 to 4 carbon atoms, a phenyl group, an alkoxy group having 1 to 4 carbon atoms, an amino group, an acylamino group having 1 to 4 carbon atoms, or a heterocyclic ring; and $R^2$ represents hydrogen atom, an alkyl group having 1 to 4 carbon atoms, an alkenyl group having 2 to 4 carbon atoms, a phenyl group, an acyl group having 1 to 4 carbon atoms, a carbamoyl group, or a heterocyclic ring; or or $R^1$ and $R^2$ together form a 5- or 6-membered heterocyclic ring, which may be condensed with another ring.

2. A bleaching composition as in claim 1 wherein the component (1) is a persulfate.

3. A bleaching composition as in claim 1 wherein the component (1) is an inorganic ferric salt.

4. A bleaching composition as claimed in claim 1 wherein the component (2) is a chloride.

5. A bleaching composition as in claim 1 wherein the compound (2) is a bromide.

6. A bleaching composition as in claim 4, wherein said chloride is potassium chloride, sodium chloride or ammonium chloride.

7. A bleaching composition as in claim 5, wherein said bromide is potassium bromide, sodium bromide or ammonium bromide.

8. A bleaching composition as in claim 1, wherein the compound represented by formula [I] is succinimide or phthalimide.

9. A bleaching composition as in claim 1, wherein the compound represented by formula [I] is pyrrolidone, saccharin, hydantoin, uracil, or cyanuric acid.

10. A bleaching composition as in claim 1, wherein the compound represented by formula [Ia] or [I-b] is used in an amount of from about $2\times10^{-6}$ mole to $1\times10^{-1}$ mole per mole of the bleaching solution.

11. A bleaching composition as in claim 2, wherein said persulfate is potassium persulfate, sodium persulfate, or ammonium persulfate.

12. A bleaching composition as in claim 3, wherein said inorganic ferric salt is selected from the group consisting of ferric chloride, ferric bromide, ferric sulfate, and ferric nitrate.

13. A photographic process wherein image-wise exposure, development, bleaching and fixing are carried out and the bleaching is carried out with a composition comprising (1) a persulfate or an inorganic ferric salt, (2) a water-soluble halide, and (3) a compound represented by the formula [I-a] or [I-b]

$$R^1—CO—NH—R^2 \quad [I\text{-}a]$$

$$R^1—SO_2—NH—R^2 \quad [I\text{-}b]$$

$R^1$ represents an alkyl group having 1 to 4 carbon atoms, an alkenyl group having 2 to 4 carbon atoms, a phenyl group, an alkoxy group having 1 to 4 carbon atoms, an amino group, an acylamino group having 1 to 4 carbon atoms, or a heterocyclic ring; and $R^2$ represents hydrogen atom, an alkyl group having 1 to 4 carbon atoms, an alkenyl group having 2 to 4 carbon atoms, a phenyl group, an acyl group having 1 to 4 carbon atoms, a carbamoyl group, or a heterocyclic ring; or $R^1$ and $R^2$ together form a 5- or 6-membered heterocyclic ring, which may be condensed with another ring.

14. A process as in claim 13, wherein said processing additionally comprises using as a bleaching accelerator a mercapto compound represented by the formula [II]

$$X—A—SH \quad [II]$$

wherein A represents an alkylene group or a nitrogen-containing unsaturated divalent heterocyclic ring, and X represents an alkyl-substituted or unsubstituted amino group, a nitrogen-containing saturated heterocyclic ring, a hydroxy group, a carboxy group or a sulfo group.

15. A process as in claim 14, wherein said bleaching accelerator is a compound represented by the formula [III]:

$$X—(CH_2)_n—SH \quad [III]$$

wherein X represents an N,N-dimethylamino group, an N,N-diethylamino group, a carboxy group or a sulfo group, and n represents an integer of 2 or 3.

16. A process of claim 14 or 15, wherein said bleaching accelerator is used in the bath prior to bleaching or the bleaching bath.

17. A process of claim 13 or 14, wherein said bleaching accelerator is selected from the group consisting of

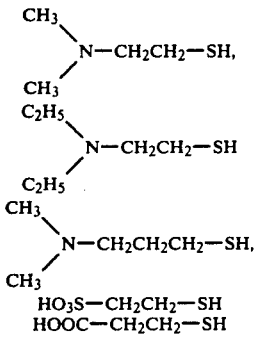

18. A process of claims 13 or 14, wherein said bleaching accelerator is a compound represented with the following formula:

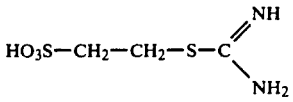

* * * * *